US006864849B2

(12) United States Patent
Hart

(10) Patent No.: US 6,864,849 B2
(45) Date of Patent: Mar. 8, 2005

(54) METHOD AND APPARATUS FOR CREATING AN EH ANTENNA

(76) Inventor: Robert T. Hart, 814 Madison Rd., Eatonton, GA (US) 31024

( * ) Notice: Subject to any disclaimer, the term of this patent is extended or adjusted under 35 U.S.C. 154(b) by 0 days.

(21) Appl. No.: 10/302,952

(22) Filed: Nov. 22, 2002

(65) Prior Publication Data

US 2003/0107524 A1 Jun. 12, 2003

Related U.S. Application Data

(63) Continuation-in-part of application No. 09/576,449, filed on May 23, 2000, now Pat. No. 6,486,846.

(51) Int. Cl.[7] ..... H01Q 9/24

(52) U.S. Cl. ..... 343/773; 343/822; 343/859; 343/860

(58) Field of Search ..... 343/773, 775, 343/807, 822, 859, 850, 774, 852, 860, 808, 840, 821, 866, 741; H01Q 9/24

(56) References Cited

U.S. PATENT DOCUMENTS 4,801,944 A * 1/1989 Madnick et al. ..... 343/744
6,147,653 A * 11/2000 Wallace et al. ..... 343/702
6,366,247 B1 * 4/2002 Sawamura et al. ..... 343/702
6,486,846 B1 * 11/2002 Hart ..... 343/773
6,621,467 B1 * 9/2003 Marsh ..... 343/850

* cited by examiner

*Primary Examiner*—Hoanganh Le
(74) *Attorney, Agent, or Firm*—Bryan W. Bockhop; Arnall Golden Gregory LLP

(57) ABSTRACT

An antenna system for transmitting and receiving, in association with a radio device that develops an H-field and an E-field corresponding to a radio frequency power signal having a voltage and a current, the voltage having a phase relationship to the current. The antenna system includes a Hertz-type radiating element. A phasing and matching circuit is electrically coupled between the Hertz-type radiating element and the radio device. The phasing and matching circuit adjusts the phase relationship between the voltage and the current of the radio frequency power signal so that the H-field and the E-field are in nominal time phase. This enhances the performance of all of the antenna parameters in addition to allowing reduction in size.

9 Claims, 4 Drawing Sheets

METHOD AND APPARATUS FOR CREATING AN EH ANTENNA

CROSS REFERENCE TO A RELATED PATENT APPLICATION

The present patent application is a continuation-in-part of U.S. patent application Ser. No. 09/576,449 filed on May 23, 2000, now U.S. Pat. No. 6,486,846, which is incorporated by reference in its entirety.

BACKGROUND OF THE INVENTION

1. Field of the Invention

The present invention relates to radio frequency communications and, more specifically, to an antenna system employed in radio frequency communications.

2. Description of the Prior Art

Radio signals usually start with electrical signals that have been modulated onto a radio frequency carrier wave. The resulting radio signal is transmitted using an antenna. The antenna is a system that generates an electrical field (E field) and a magnetic field (H field) that vary in correspondence with the radio signal, thereby forming radio frequency radiation. At a distance from the antenna, as a result of transmission effects of the medium through which the radio frequency radiation is being transmitted, the E field and the H field fall into phase with each other, thereby generating a Poynting vector, which is given by $S=E\times H$, where S is the Poynting vector, E is the E field vector and H is the H field vector.

Conventional Hertz antenna systems are resonant systems that take the form of wire dipoles or ground plane antennas that run electrically in parallel to the output circuitry of radio frequency transmitters and receivers. Such antenna systems require, for maximum performance, that the length of each wire of the dipole, or the radiator of the ground plane, be one fourth of the wavelength of the radiation being transmitted or received. For example, if the wavelength of the radiation is 1000 ft., the length of the wire must be 250 ft. Thus, the typical wire antenna requires a substantial amount of space as a function of the wavelength being transmitted and received.

A Crossed Field Antenna, as disclosed in U.S. Pat. No. 6,025,813, employs two separate sections which independently develop the E and H fields and are configured to allow combining the E and H fields to generate radio frequency radiation. The result is that the antenna is not a resonant structure, thus a single structure may be used over a wide frequency range. The Crossed Field Antenna is small, relative to wavelength (typically 1% to 3% of wavelength) and provides high efficiency. The Crossed Field Antenna has the disadvantage of requiring a complicated physical structure to develop the E and H fields in separate sections of the antenna. The Crossed Field Antenna also requires an associated complex matching/phasing network to feed the antenna.

Radio Frequency Identification (RF ID) is an emerging field in which a small radio frequency transponder is embedded in or attached to objects so that the objects may be uniquely identified and carry associated information in the memory of the transponder. By international agreement these systems may operate on assigned frequencies from 125 KHz to 4 GHz, with many operating at 13.56 MHz. For practical applications, both the transponder and the associated "reader" of RF ID systems require small antennas, with loop antennas the preferred choice. However, with traditional Hertz loop antennas the distance between the reader and transponder is very limited and the transponder must be parallel to the reader antenna. This is due to low efficiency and narrow bandwidth, and the use of only a magnetic field concentrated around the loop conductor, without the benefit of local radiation. Therefore, there is a need for a compact antenna with high performance.

SUMMARY OF THE INVENTION

The disadvantages of the prior art are overcome by the present invention which, in one aspect is an antenna system for transmitting and receiving, in association with a radio device, that develops an H-field and an E-field corresponding to a radio frequency power signal having a voltage and a current, the voltage having a phase relationship to the current. The antenna system includes a Hertz-type radiating element. A phasing and matching circuit is electrically coupled to the Hertz-type radiating element and to the radio device. The phasing and matching circuit provides conjugate impedance matching between the radio and antenna and adjusts the phase relationship between the voltage and the current of the radio frequency power signal so that the H-field and the E-field developed by the antenna system are in nominal time phase, thereby resulting in the formation of radiation at the antenna.

In another aspect, the invention is an antenna system for transmitting and receiving, in association with a radio device, that develops an E-field and an H-field that correspond to a radio frequency power signal having a current and a voltage at a radio frequency. The current and the voltage are phase related. The antenna system includes a first radiating element made from a conductive material and a second radiating element made from a conductive material. The second radiating element is spaced apart from and in alignment with the first radiating element. A phasing and matching network is in electrical communication with the first radiating element, the second radiating element and the radio device. The phasing and matching network aligns the relative phase between the current and the voltage of the radio frequency power signal so that the H-field is nominally in time phase with the E-field.

In yet another aspect, the invention is a loop antenna system that includes a loop-shaped conductor having a first end and a spaced-apart second end. A gap is defined between the first end and the second end. A capacitor electrically couples the first end to the second end. A shunt is electrically coupled to a first portion of the loop-shaped conductor. A T-type network is electrically coupled to the shunt. The T-type network is configured so the E-field is in nominal time phase with the H-field.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
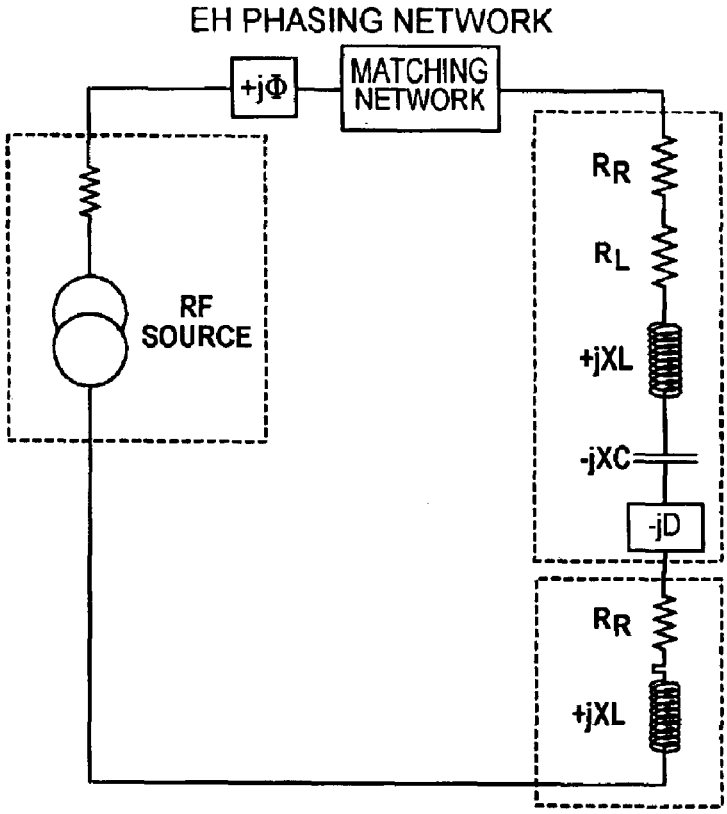
FIG. 1A is a schematic diagram of a first illustrative embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

A general discussion of Poynting vector theory may be found in the disclosure of U.S. Pat. Nos. 5,155,495 and 6,025,813, which are incorporated herein by reference.

The EH Antenna is a Hertz antenna driven with a phase shift network that allows radiation to occur at the antenna, with associated benefits. To put this in proper perspective, the equivalent circuit is shown in FIG. 1A. Note a RF source driving a EH Phasing Network followed by a matching network. The purpose of the matching network is to provide a conjugate impedance match to the antenna. For now, disregard the EH phase shift network ($+j\Phi$) while the Hertz antenna is defined. In one embodiment of the invention, the EH antenna is essentially a modified Hertz antenna.

The equivalent circuit of a Hertz antenna includes both radiation resistance ($R_R$) and loss resistance ($R_L$) in addition to both inductance and capacitance denoted respectively as $+jX_L$ and $-jX_C$. Each of these has a value that is a direct function of the physical characteristics of the antenna. Small Hertz antennas are capacitors with low inductance. In this case an external inductance is added to cancel the capacitive reactance, thus to resonate the antenna. The word resonance is used to indicate that the current applied to the antenna is in phase with the applied voltage, thus allowing maximum current flow, thus maximum power transfer from the source to the antenna. As the size of the antenna increases, both the capacity and the inductance increase until their reactance is equal when the antenna element is near ¼ wavelength, allowing the antenna to be self resonant. These larger antennas also have a higher radiation resistance and a higher loss resistance. If the antenna is short in length but large in diameter, it will have a high capacity and low inductance. The effect is to reduce the amount of external inductance necessary for resonance, thus effectively increasing the bandwidth and, since the loss in the external inductance is proportional to size, to increase the efficiency of the system (the antenna+the network).

The function denoted as $-jD$ denotes the phase shift between the applied voltage and the displacement current through the natural capacity of the antenna. This signifies that the H field of a Hertz antenna leads the phase of the E field. This is an integral part of every Hertz antenna.

The Hertz antenna is converted to an EH Antenna by inserting a phase shift network. This cancels the effect of $-jD$. When the phase of the current from the source is delayed 90 degrees ($+j\Phi$) relative to the voltage, the E and H fields of the antenna are now in phase.

The effect causes new components to be included in the antenna. An additional radiation resistance ($R_R$) may be added to improve the efficiency of the antenna and enhance the bandwidth. An inductance ($+jX_L$) may be added due to displacement current through the natural capacity of the antenna. This effectively increases the capacity of the antenna by subtracting from $-jX_C$, thus reducing the amount of tuning inductance necessary in the network to resonate the system and reducing loss in the tuning inductor and lowering the Q. This component effectively increases the capacity by a factor of the square root of two for very small EH Antennas that do not have wire inductance.

It should be noted that the value of the individual added components is a function of the physical configuration of the original Hertz antenna. For example, a small EH dipole has almost no inductance due to current on very short conductors. Because a small EH Antenna does not have an H field developed from inductance on a wire, it can be very small and exhibit overall high efficiency and large bandwidth. Further, since the EH Antenna concept fully satisfies the Poynting Theorem, it brings the beginning of radiation from the far field to the antenna. Therefore, large E and H fields are no longer required and thus EMI is virtually eliminated. When used as a receiving antenna, it does not respond to local independent E or H fields, thus it provides superior signal to noise ratio.

The voltage and current applied to a Hertz antenna are in phase, therefore the E and H fields are not in phase, thus radiation does not occur until a great distance from the antenna. A proper phase shift network allows the Hertz antenna to become an EH Antenna where a 90 degree phase delay between the current and voltage cause the E and H fields to be in phase. Therefore, the EH antenna is able to transfer power from the transmitter directly to radiation. In the context of this paragraph, the word antenna includes both the physical structure and the conjugate matching network.

Figure 1B:
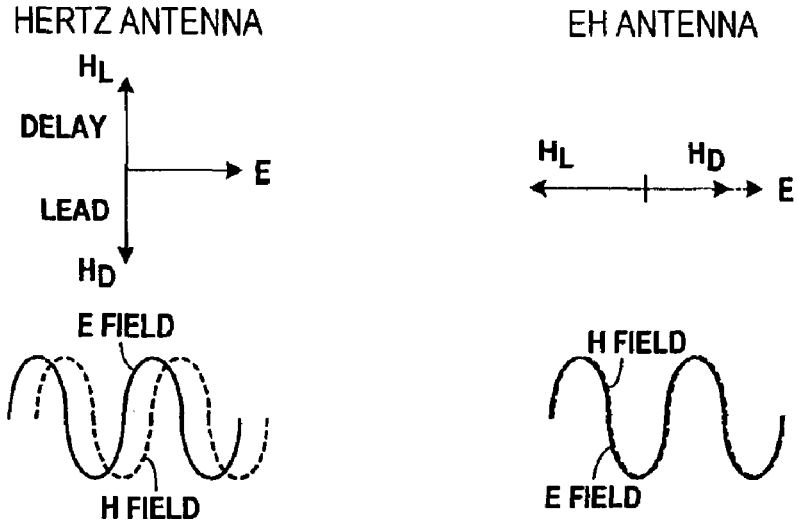
FIG. 1B is a vector and time phase diagram relating an EH antenna to a Hertz antenna.

To gain a better understanding of the EH Antenna concept, it is necessary to look at the phase between the E and H fields. As shown in FIG. 1B, the E field for a Hertz antenna is developed by the applied voltage. The $H_L$ field is developed by the current through the inductance of the antenna conductor, thus it is delayed in time phase. The clock convention is used for delay and lead. The $H_D$ field is developed by the displacement current through the natural capacity, thus it leads the applied voltage in time phase. Radiation can not be created at the Hertz antenna because the E and H fields are not in phase.

The EH antenna is created by shifting the phase of the applied current relative to the applied voltage. This causes $H_L$ to be delayed an additional 90 degrees, and is now 180 degrees relative to the applied voltage. $H_D$ has also been delayed 90 degrees and is now in phase with the applied voltage. In other words, the $H_L/H_D$ vector is rotated counter clock wise. It would appear that $H_L$ subtracts from $H_D$ since they are 180 degrees relative to each other. However, it is believed that the entire useful H field of any antenna is caused by displacement current through the natural capacity. As evidence of this, a very small dipole EH antenna has almost no conductor inductance, thus $H_L$ is almost 0. Since E and $H_D$ are in phase, radiation is created at the antenna. This also implies that we can have a very efficient antenna since there is no loss resistance associated with $H_D$. Further, since E and $H_D$ are in phase allowing power to be radiated, a large radiation resistance is created indicating an efficient power transfer from the EH Antenna to radiation.

Since there is a necessary physical orientation between the E and H fields to cause radiation in accordance with the Poynting Theorem, the above can not be accomplished by using a phase lead in the EH network rather than a phase delay. This is further evidence that the H field of all antennas is developed by displacement current.

The minimum size for an EH Antenna is determined by the allowable inefficiency and/or bandwidth for the intended use, which is dictated by the amount of antenna capacity resulting in the necessary external tuning inductance with its associated loss. A very small EH antenna has no measurable loss in the conductors, thus the total loss is in the phasing matching network. This is typically a small fraction of a dB. As an example, an EH Antenna dipole with 0.005 wavelength elements and a diameter of ⅓ the length produces radiation levels greater than a 0.5 wavelength Hertz dipole.

Figure 2:
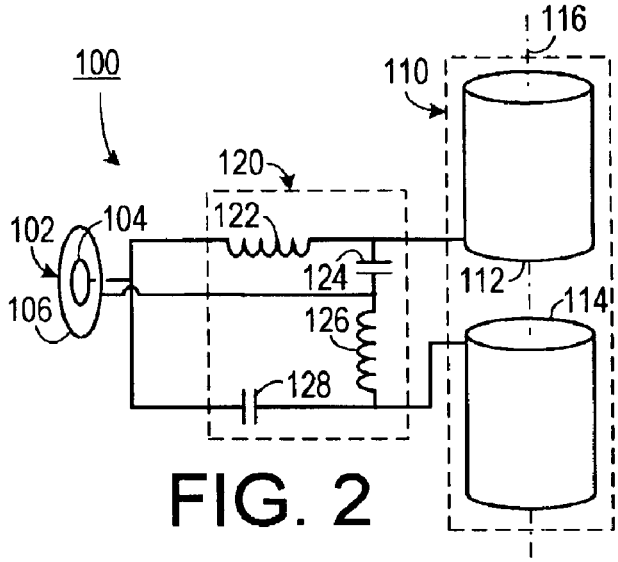
FIG. 2 is a schematic diagram of one illustrative embodiment of the invention.

As shown in FIG. 2, one embodiment of the invention is illustrated as an antenna system 100 for transmitting and receiving, in association with a radio device 102 (such as a transmitter or a receiver), having an E-field and an H-field that corresponds to a radio frequency power signal having a current and a voltage at a radio frequency.

The antenna system 100 includes an antenna unit 110 and a phasing/matching network 120. The antenna unit 110 includes a first radiating element 112 made of a conductive material such as a metal (for example, aluminum) and a spaced-apart second radiating element 114, also made of a conductive material such as a metal. The first radiating element 112 and the second radiating element 114 are substantially in alignment with each other, so that both tend to be disposed along a common axis 116. While the first radiating element is ideally coaxial with the second radiating element, they may be off coaxial without departing from the scope of the invention. However, performance of the antenna may degrade as the radiating elements get further off coaxial. Typically, the height of the antenna unit 110 need only be about 1.5% of the wavelength. Thus, the invention allows for relatively compact antenna designs.

In the embodiment of FIG. 2, the first radiating element 112 and the second radiating element 114 each comprise a cylinder. As will be shown below, the radiating elements could include conic sections as well, or many other shapes (or combinations thereof), as will be readily understood by those of skill in the art of antenna design.

The phasing and matching network 120 is in electrical communication with the first radiating element 112, the second radiating element 114 and the radio device 102. The phasing and matching network 120 shifts the relative phase between the current and the voltage of the radio frequency power signal so that the H-field of the antenna is nominally in time phase with the E-field. The wires connecting the phasing and matching network 120 to the antenna unit 110 should be as short as practical so as to minimize transmission line effects. Because the E field and the H field are substantially in phase with each other near antenna unit 110 a Poynting vector is created almost immediately near the antenna unit 110.

In one illustrative embodiment, the phasing and matching network 120 includes a first inductor 122 that electrically couples a first terminal 104 of the radio device 102 to the first radiating element 112 and a first capacitor 124 electrically couples a second terminal 106 of the radio device 102 to the first radiating element 112. A second inductor 126 electrically couples the second terminal 106 of the radio device 102 to the second radiating element 114. A second capacitor 128 electrically couples the first terminal 104 to the second radiating element 114. While one example of a reactive element circuit configuration embodying a phasing and matching network 120 is shown in FIG. 2, it is understood that many other circuit configurations may be used without departing from the scope of the invention.

An important feature of the phasing and matching network 120 is that it performs the step of shifting the relative phase between the current and the voltage of the radio frequency power signal so that the H-field of the antenna is nominally in time phase with the E-field. As will be readily appreciated by those of skill in the art, the specific circuit elements and configuration used are unimportant so long as the result is proper performance of the phase shifting function.

In one specific example of and EH antenna having an operating frequency of 7 MHz with a bandwidth of 500 KHz, the first inductor 122 has an inductance of 17 $\mu$H, the first capacitor 124 has a capacitance of 30 pf, the second inductor has an inductance of 19 $\mu$H and the second capacitor has a capacitance of 42 pf. The phasing and matching network 120 is connected to the transmitter/receiver 102 by a coaxial cable (not shown). The first radiating element 112 and the second radiating element 114 are each aluminum cylinders having a height of 12 in. and a diameter of 4.5 in. and are spaced apart by 4.5 in. It was observed that this embodiment resulted in a system Q (+/−3 dB bandwidth) of approximately 14.

Figure 3:
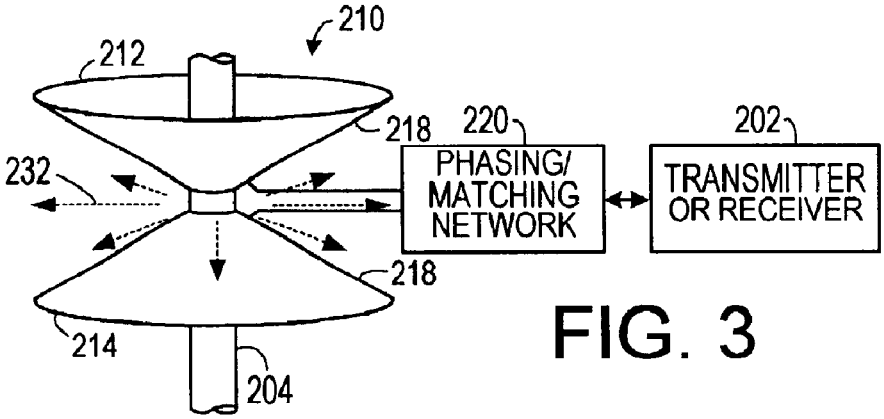
FIG. 3 is a schematic diagram of a second illustrative embodiment of the invention.

In one embodiment of the antenna unit 210, as shown in FIG. 3, the first radiating element 212 and the second radiating element 214 each comprise conic sections that are supported by an axial non-conducting pipe (such as a PVC pipe). In this embodiment, the electromagnetic radiation 232 forms between the radiating elements 212 and 214 and is directed radially away from the antenna unit 210. The angle of the conic sections of the radiating elements 212 and 214 depends on many factors and can vary depending on the specific application. The angle between the operative surfaces 218 of the radiating elements 212 and 214 can be selected in a range from nearly zero degrees (forming extremely wide diameter cones) to 180° (forming coaxial cylinders, as shown in FIG. 2). Theoretically, if the operative surfaces are exactly parallel (such that they form parallel disks) then the electromagnetic radiation would not escape the disks.

In one specific embodiment, used to transmit or receive a radiation having a wave length of 934 feet at 1 MHz, the wide ends of the conic sections have a diameter of 14.49 feet and a height of 1.95 feet each, with a 30° angle between the operative surfaces 218. In this embodiment, the radiating elements 212 and 214 are supported by a coaxial 8 in. PVC pipe.

Figure 4:
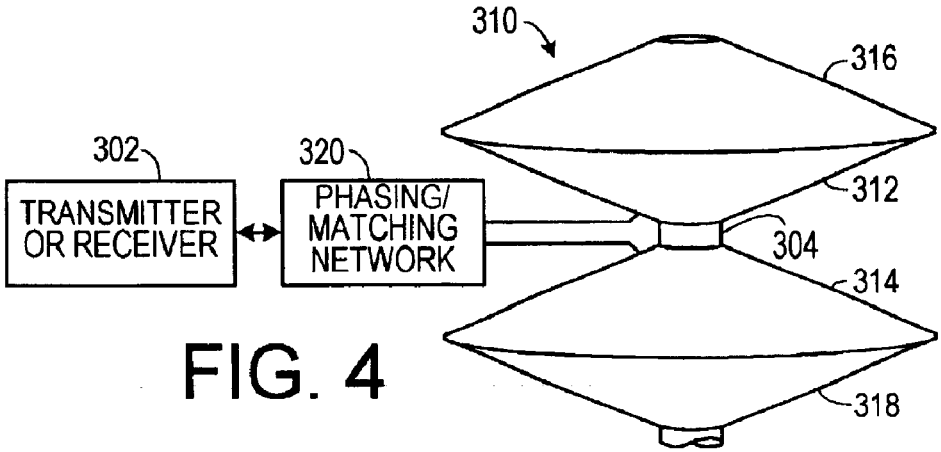
FIG. 4 is a schematic diagram of the embodiment of FIG. 2 with covers added to the conic sections of the antenna.

As shown in FIG. 4, a first cover 316 may be added to the first radiating element 312 to keep rain, snow and bird nests, etc., out of the first radiating element 312. Similarly, a second cover 318 may be added to the second radiating element 314 to keep out similar such debris.

Figure 5:
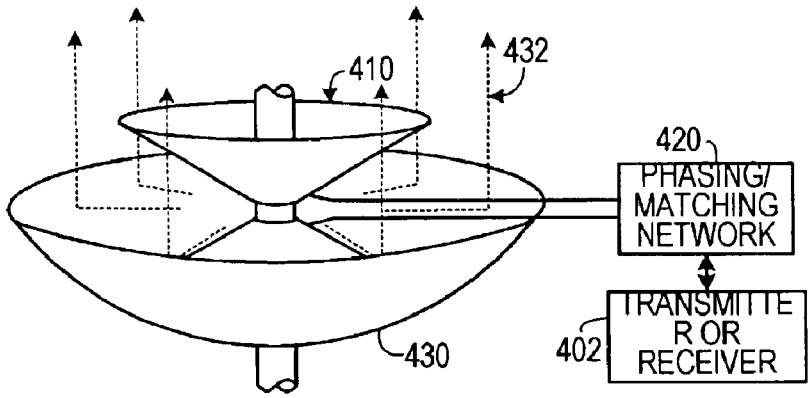
FIG. 5 is a schematic diagram of a third illustrative embodiment of the invention adapted for generating a substantially directed beam of radiation.

As shown in FIG. 5, the antenna unit 410 may be placed in a reflective shape 430. Such an embodiment could be used in directing a beam 432 at a selected object. Such a shape 430 could be a parabolic reflector or some other shape (such as an inverted cone). When the beam is directed upward by the reflective shape 430 so that the beam 432 follows a near vertical profile, the embodiment of FIG. 5 could be used in near vertical incidence communications.

Figure 6:
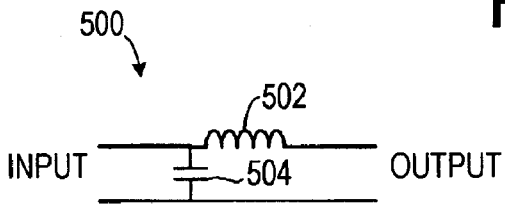
FIG. 6 is a schematic diagram of an L-type phasing network.

As shown in FIG. 6, one type of L-type network 500, which can be used as a phase shift element between two impedances that have no reactance, includes an inductor 502 and a capacitor 504. The L-type network 500 could transform between 50+j0 ohms and 25+j0 ohms and have a corresponding phase delay of 45 degrees. Phase delay means that the current is delayed relative to the voltage. In other words, if the voltage and current are in phase at the input to the network, at the output of the network (if it is properly terminated) the current will be delayed 45 degrees relative to the voltage.

Figure 7:
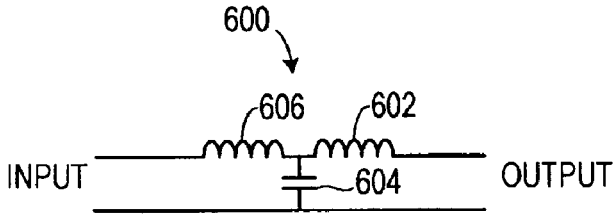
FIG. 7 is a schematic diagram of a T-type phasing network.

As shown in FIG. 7, a T-type network 600 includes a first inductor 606 that is in series with a second inductor 602. The first inductor 606 and the second inductor 602 electrically couple the transmitter to the antenna. A capacitor 604 couples a common node between the first inductor 606 and the second inductor 602 to ground. A T-type network 600 is versatile in that it can match most source impedances to most load impedances with any desired phase shift and allows a predetermined amount of phase delay as desired for any particular antenna requiring a phase delay of less than 180 degrees. For antennas requiring a nominal 180 degrees, an L-type network 500 can be used to precede a T-type network 600, thus reducing the amount of phase shift required of the T-type network 600. It should be noted that a T-type network must operate between a low and high impedance to effect phase delay, thus the antenna impedance was chosen to be 60 ohms, expecting the nominal source impedance to be 50 ohms.

Figure 8:
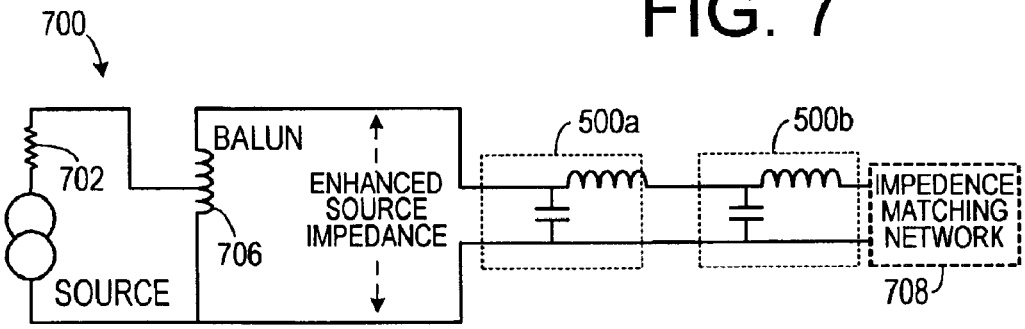
FIG. 8 is a schematic diagram of a hybrid L-type and Balun-type phasing network.

As shown in FIG. 8, a hybrid network 800 could include a balun network 700 followed by a first L-type network 500*a* to transform from 200 ohms to 100 ohms with a delay of 45 degrees. The balun network 700 may be used for transformation from a low to a high impedance. If the tap on the inductor 706 is set at 50% and if the input impedance is 50 ohms, then the output impedance will be 200 ohms. An impedance matching network 708 may be included, immediately prior to the radiating elements of the antenna to ensure that the antenna is in resonance, if the radiating elements are not already matched. The first L-type network 500*a* could be followed by a second L-type network 500*b* with another 45 degrees for a total of 90 degrees phase delay. The total network would have an impedance transformation from 50+j0 to 50+j0 ohms. The hybrid network 800 could be used in the direct conversion of a "tuned" Hertz antenna to a EH Antenna. Since the antenna has been resonated and matched to the transmission line (assume 50 ohms), a 1:4 balun could be used to transform the line impedance to 200 ohms. This would be followed by the first L-type network 500*a* transforming the impedance to 100 ohms with an attendant 45 degree phase delay. The second L-type network 500*b* would provide a final transformation to 50 ohms and an additional 45 degrees. Thus, a phase shift network of 90 degrees could be added to convert the Hertz antenna to an EH Antenna.

Figure 9:
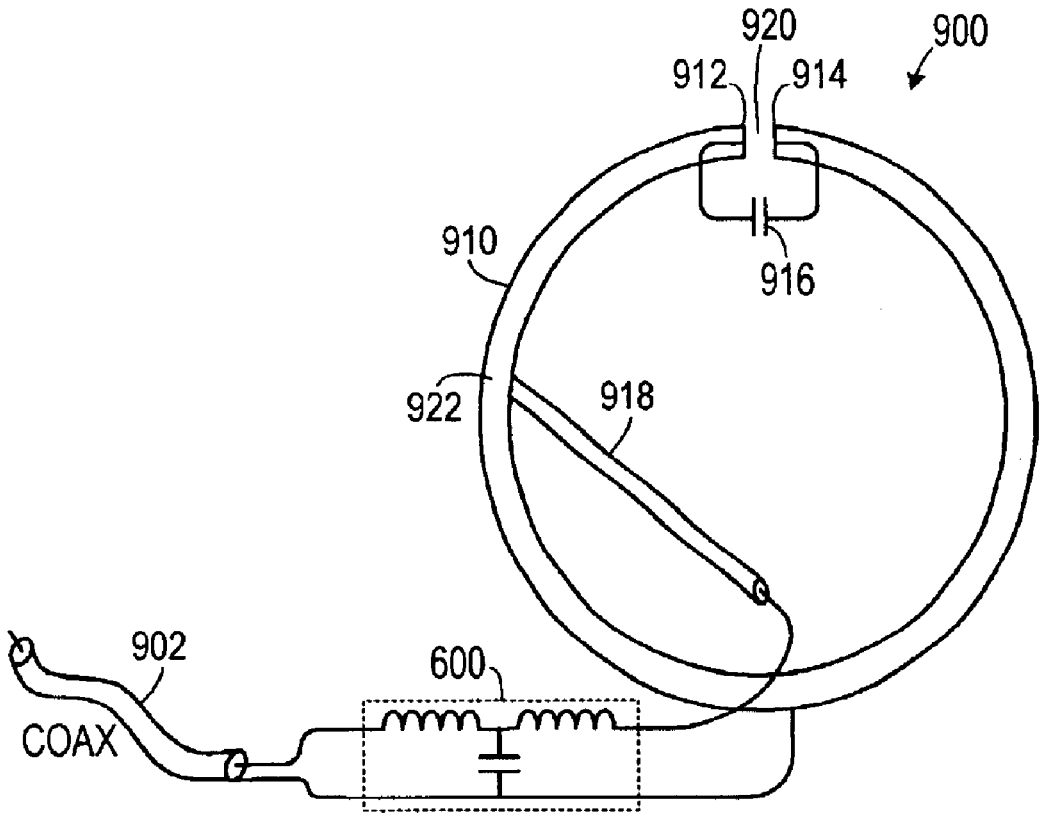
FIG. 9 is a schematic diagram of a loop antenna with a shunt feed.

One example of an antenna useful for application to RF identification systems is a small loop antenna, which is used as the transmitting/receiving antenna in association with the remote transponder. The small loop antenna is the converse of a small dipole. To create an EH loop antenna, the phase between the E and H fields is controlled to bring the fields into time alignment. A loop antenna system 900 is shown in FIG. 9. The loop antenna system 900 includes a loop-shaped conductor 910 having a first end 912 and a spaced-apart second end 914. A gap 920 being defined between the first end 912 and the second end 914. A capacitor 916 electrically couples the first end 912 to the second end 914. A shunt 918 is electrically coupled to a first portion 922 of the loop-shaped conductor 910. A T-type network 600 that is electrically coupled to the shunt 918 and to a transmitter via a coaxial cable 902. The loop 910 is resonated with the capacitor 916 and the loop is shunt 918 fed (or fed across the tuning capacitor). For a shunt 918 feed, the impedance can have a nominal impedance of 50+j0.

In using a loop antenna for one RF Identification system, before the transformation of a loop to an EH antenna, a resistor was required to reduce the Q of the antenna (damping resistor) due to the wide band modulation used. Test results without the resistor and after being converted to an EH Antenna indicate excellent performance with all types of transponders and there is no heat inside of the closed container of the antenna. In addition, the performance was enhanced in another way. Before transformation, it was difficult or impossible to communicate with transponders that were not oriented in a zero degree position (transponder and loop antenna in parallel). Using the EH concept, the enhanced fields of the antenna allowed communication with a transponder having any arbitrary orientation. Further; the transformation allows a significant reduction of the transmitter power or a significant in range.

The above-described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. An antenna system for transmitting and receiving, in association with a radio device having an H-field and an E-field corresponding to a radio frequency power signal having a voltage and a current, the voltage having a phase relationship to the current, the antenna system comprising:

a. a Hertz-type radiating element; and b. a phasing and matching circuit, electrically coupled to the Hertz-type radiating element and to the radio device, that adjusts the phase relationship between the voltage and the current of the radio frequency power signal so that the H-field and the E-field are in nominal time phase.

2. The antenna system of claim 1, wherein the Hertz-type radiating element comprises a dipole conductor.

3. The antenna system of claim 1, wherein the Hertz-type radiating element comprises a loop antenna.

4. The antenna system of claim 1, wherein the phasing and matching circuit comprises at least one L-type phasing network.

5. The antenna system of claim 1, wherein the phasing and matching circuit comprises at least one T-type phasing network.

6. The antenna system of claim 1, wherein the phasing and matching circuit includes at least one balun transformer.

7. An antenna system for transmitting and receiving, in association with a radio device, an E-field and an H-field corresponding to a radio frequency power signal having a current and a voltage at a radio frequency, the current and the voltage each having a phase, the radio device having a first terminal and a second terminal that are capable of conducting the current and the voltage, the antenna system comprising:

a. a first radiating element comprising a conductive material;

b. a second radiating element comprising a conductive material, the second radiating element spaced apart from and in alignment with the first radiating element; and electrically coupled to the second terminal of the radio device; and c. a phasing and matching network, in electrical communication with the first radiating element, the second radiating element and the radio device, that aligns the relative phase between the current and the voltage of the radio frequency power signal so that the H-field is nominally in time phase with the E-field, the phasing and matching network including:

i. a first inductor that electrically couples the first radiating element to a first node;

ii. a capacitor that electrically couples a second terminal of the radio device to the first node; and iii. a second inductor that electrically couples the first terminal of the radio device to the first node.

8. An antenna system for transmitting and receiving, in association with a radio device, an E-field and an H-field corresponding to a radio frequency power signal having a current and a voltage at a radio frequency, the current and the voltage each having a phase, the antenna system comprising:

a. a first radiating element comprising a conductive material;

b. a second radiating element comprising a conductive material, the second radiating element spaced apart from and in alignment with the first radiating element, the first radiating element and the second radiating element connected to a matching network that causes the antenna to be resonant;

c. a balun transformer, having an output;

d. a first L-type network having an input and an output, the input being electrically coupled to the output of the balun transformer; and e. a second L-type network having an input and an output, the input being electrically coupled to the output of the first L-type network, the output of the second L-type network being electrically coupled to the matching network, the L-type network configured so that the first radiating element and the second radiating element are capable of generating an E-field and an H-field, wherein the E-field is in nominal time phase with the H-field.

9. A loop antenna system, comprising:

a. a loop-shaped conductor having a first end and a spaced-apart second end, a gap being defined between the first end and the second end;

b. a capacitor electrically coupling the first end to the second end;

c. a shunt that is electrically coupled to a first portion of the loop-shaped conductor; and d. a T-type network that is electrically coupled to the shunt, the T-type network configured so that the loop-shaped conductor is capable of generating an E-field and an H-field, wherein the E-field is in nominal time phase with the H-field.

* * * * *